US006401246B1

(12) United States Patent
Perez

(10) Patent No.: US 6,401,246 B1
(45) Date of Patent: Jun. 11, 2002

(54) HAIR CLIPPINGS CATCHING DEVICE

(76) Inventor: Rose M. Perez, 7805 Provance La., New Port Richey, FL (US) 34654

( * ) Notice: Subject to any disclaimer, the term of this patent is extended or adjusted under 35 U.S.C. 154(b) by 0 days.

(21) Appl. No.: 09/931,805

(22) Filed: Aug. 17, 2001

(51) Int. Cl.[7] ..... A41B 13/10
(52) U.S. Cl. ..... 2/50
(58) Field of Search ..... 2/50, 48, 49.1, 2/49.2, 52, 51, 49.3, 49.4, 49.5, 88, 89, 60, 468, 174; 132/212, 213

(56) References Cited

U.S. PATENT DOCUMENTS

| | | | | | |
|---|---|---|---|---|---|
| 371,353 | A | * | 10/1887 | Perry | 2/50 |
| 899,853 | A | * | 9/1908 | Willard | 2/50 |
| 1,261,575 | A | * | 4/1918 | McLeod | 2/50 |
| 1,690,927 | A | * | 11/1928 | Dickerson | 2/50 |
| 1,722,067 | A | * | 7/1929 | Vaxes | 2/50 |
| 2,199,334 | A | * | 4/1940 | Ferry | 2/50 |
| 2,243,505 | A | * | 5/1941 | Mercer | 2/50 |
| 2,364,568 | A | * | 12/1944 | Tiscornia | 2/50 |
| 2,379,722 | A | * | 7/1945 | Kase | 2/52 |
| 2,717,389 | A | | 9/1955 | Gribble et al. | |
| 2,789,289 | A | * | 4/1957 | Stevens et al. | 2/52 |
| 2,892,909 | A | * | 6/1959 | Darnutzer et al. | 2/50 |
| 2,984,840 | A | | 5/1961 | Parco | |
| 4,689,830 | A | | 9/1987 | Williams | |
| 5,230,100 | A | | 7/1993 | Lock-Jones | |
| D375,384 | S | | 11/1996 | Baker | |
| 5,950,236 | A | | 9/1999 | Andrew | |
| 6,131,197 | A | * | 10/2000 | Wang | 2/50 |

* cited by examiner

*Primary Examiner*—Amy B. Vanatta

(57) ABSTRACT

A hair clippings catching device for preventing hair clippings from falling and collecting upon the floor and upon the user's clothing. The hair clippings catching device includes a neck band member having ends which are adapted to be removably fastened together about a user's neck; and also includes a cape assembly including a piece of material having ends which are fastenable together to form an opening centrally disposed therethrough and being adapted to extend about the users neck; and further includes fastening members being attached to the neck band member and the piece of material.

8 Claims, 4 Drawing Sheets

HAIR CLIPPINGS CATCHING DEVICE

BACKGROUND OF THE INVENTION

1. Field of the Invention

The present invention relates to hair clippings catchers and more particularly pertains to a new hair clippings catching device for preventing hair clippings from falling and collecting upon the floor and upon the user's clothing.

2. Description of the Prior Art

The use of hair clippings catchers is known in the prior art. More specifically, hair clippings catchers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,689,830; U.S. Pat. No. 2,984,840; U.S. Pat. No. 5,950,236; U.S. Pat. No. 2,717,389; U.S. Pat. No. 5,230,100; and U.S. Pat. No. Des. 375,384.

While these devices fulfill their respective, particular objectives and requirements, the aforementioned patents do not disclose a new hair clippings catching device. The inventive device includes a neck band member having ends which are adapted to be removably fastened together about a user's neck; and also includes a cape assembly including a piece of material having ends which are fastenable together to form an opening centrally disposed therethrough and being adapted to extend about the users neck; and further includes fastening members being attached to the neck band member and the piece of material.

In these respects, the hair clippings catching device according to the present invention substantially departs from the conventional concepts and designs of the prior art, and in so doing provides an apparatus primarily developed for the purpose of preventing hair clippings from falling and collecting upon the floor and upon the user's clothing.

SUMMARY OF THE INVENTION

In view of the foregoing disadvantages inherent in the known types of hair clippings catchers now present in the prior art, the present invention provides a new hair clippings catching device construction wherein the same can be utilized for preventing hair clippings from falling and collecting upon the floor and upon the user's clothing.

The general purpose of the present invention, which will be described subsequently in greater detail, is to provide a new hair clippings catching device which has many of the advantages of the hair clippings catchers mentioned heretofore and many novel features that result in a new hair clippings catching device which is not anticipated, rendered obvious, suggested, or even implied by any of the prior art hair clippings catchers, either alone or in any combination thereof.

To attain this, the present invention generally comprises a neck band member having ends which are adapted to be removably fastened together about a user's neck; and also includes a cape assembly including a piece of material having ends which are fastenable together to form an opening centrally disposed therethrough and being adapted to extend about the users neck; and further includes fastening members being attached to the neck band member and the piece of material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair clippings catching device which has many of the advantages of the hair clippings catchers mentioned heretofore and many novel features that result in a new hair clippings catching device which is not anticipated, rendered obvious, suggested, or even implied by any of the prior art hair clippings catchers, either alone or in any combination thereof.

It is another object of the present invention to provide a new hair clippings catching device which may be easily and efficiently manufactured and marketed.

It is a further object of the present invention to provide a new hair clippings catching device which is of a durable and reliable construction.

An even further object of the present invention is to provide a new hair clippings catching device which is susceptible of a low cost of manufacture with regard to both materials and labor, and which accordingly is then susceptible of low prices of sale to the consuming public, thereby making such hair clippings catching device economically available to the buying public.

Still yet another object of the present invention is to provide a new hair clippings catching device which provides in the apparatuses and methods of the prior art some of the advantages thereof, while simultaneously overcoming some of the disadvantages normally associated therewith.

Still another object of the present invention is to provide a new hair clippings catching device for preventing hair clippings from falling and collecting upon the floor and upon the user's clothing.

Yet another object of the present invention is to provide a new hair clippings catching device which includes a neck band member having ends which are adapted to be removably fastened together about a user's neck; and also includes a cape assembly including a piece of material having ends which are fastenable together to form an opening centrally disposed therethrough and being adapted to extend about the users neck; and further includes fastening members being attached to the neck band member and the piece of material.

Still yet another object of the present invention is to provide a new hair clippings catching device that is easy and convenient to use.

Even still another object of the present invention is to provide a new hair clippings catching device that saves time and eliminates having to sweep the floor after cutting the user's hair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
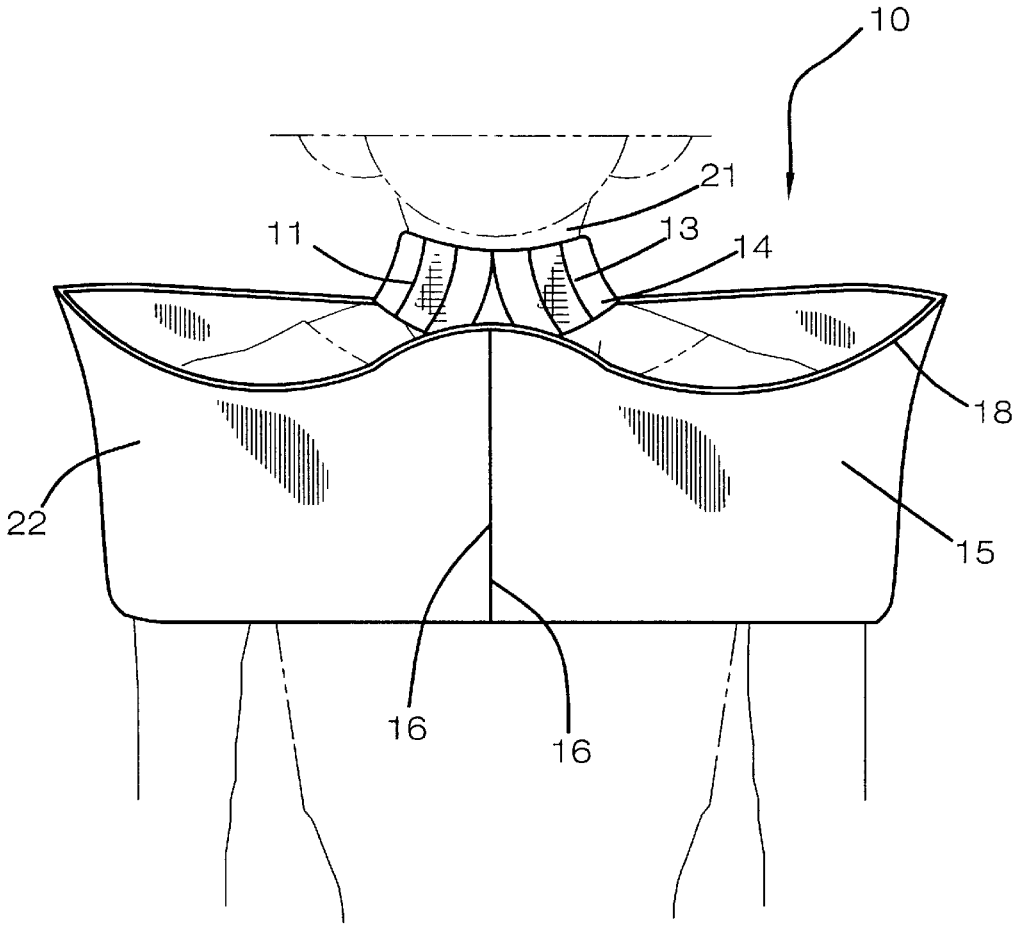
FIG. 1 is a perspective view of a new hair clippings catching device according to the present invention and shown in use.
Figure 2:
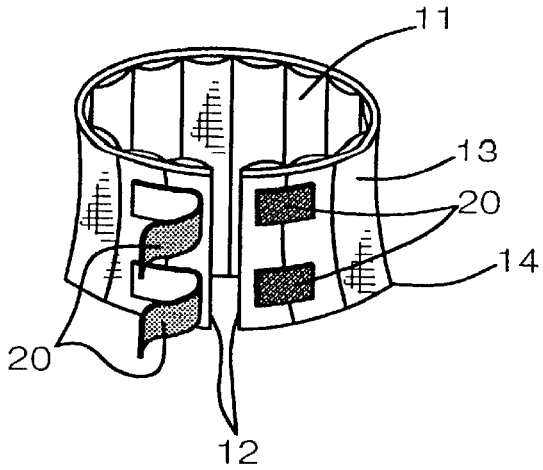
FIG. 2 is an exploded perspective view of the present invention.
Figure 2:
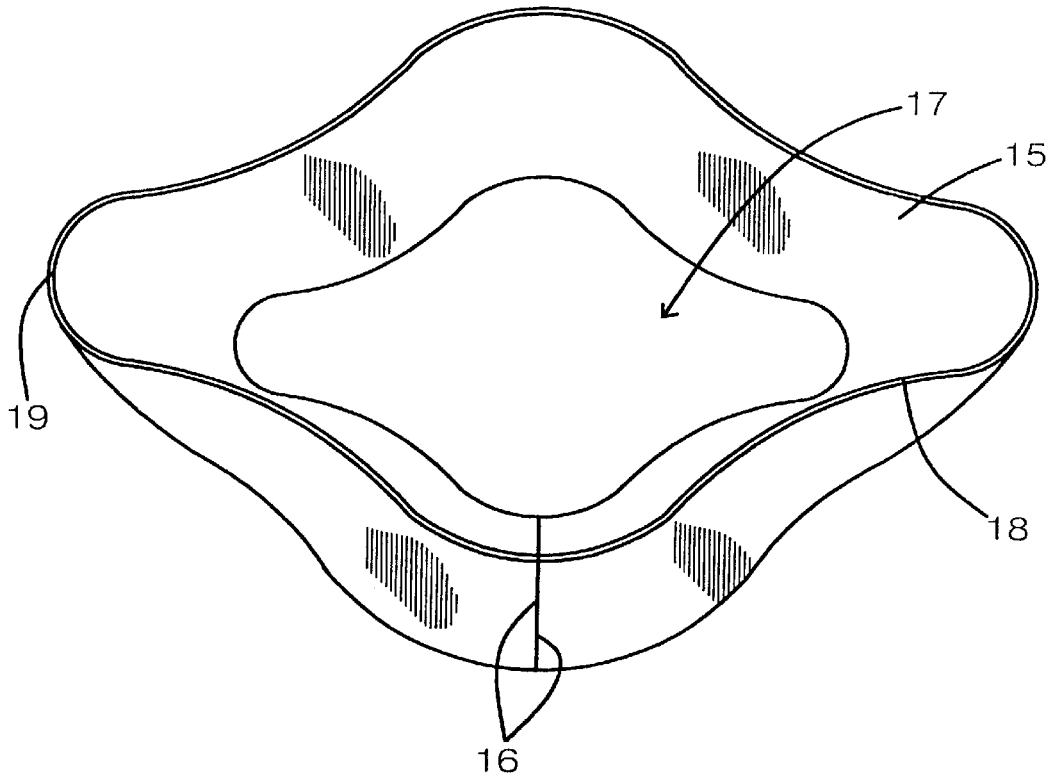
Figure 3:
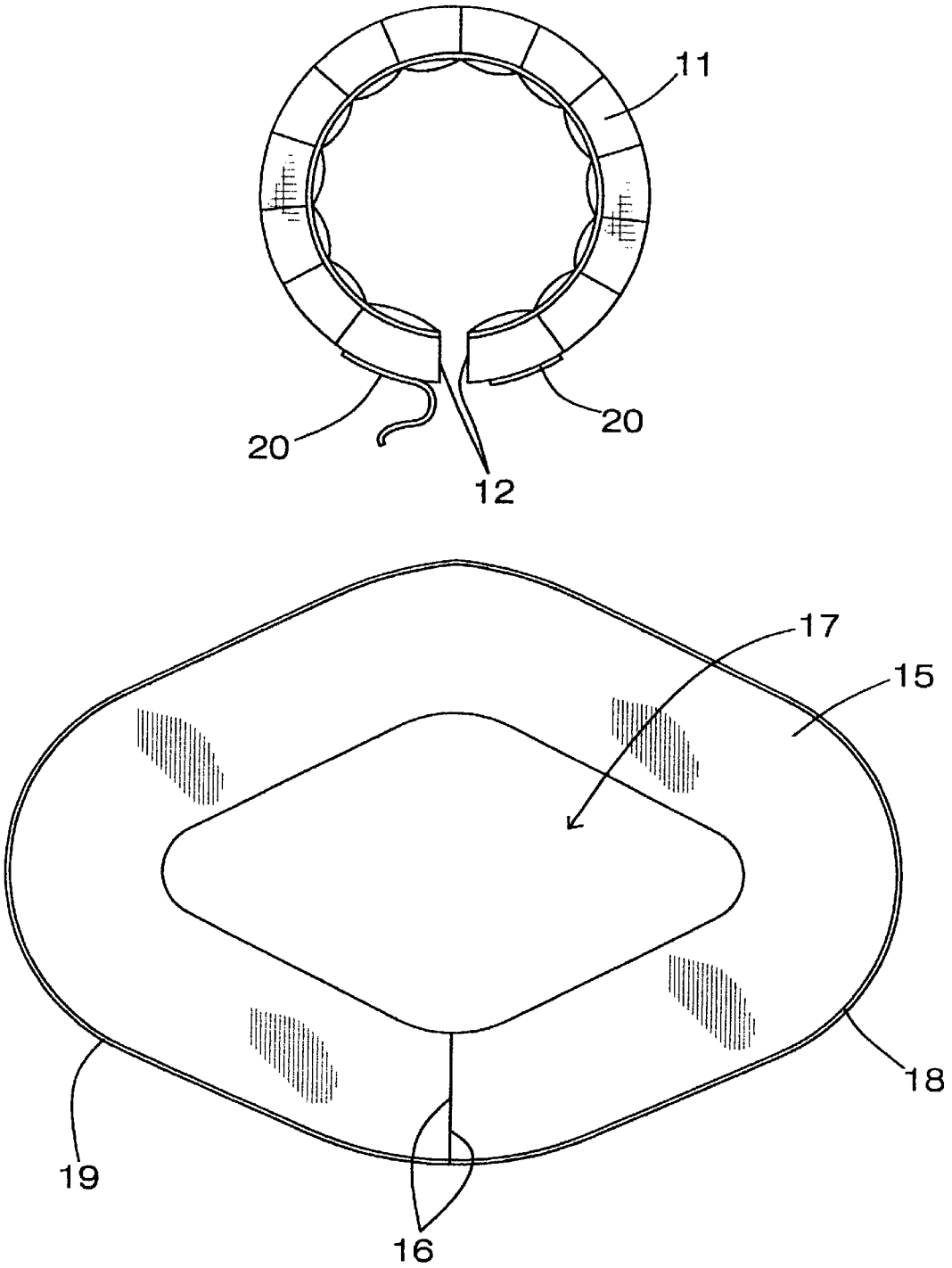
FIG. 3 is an exploded top plan view of the present invention.
Figure 4:
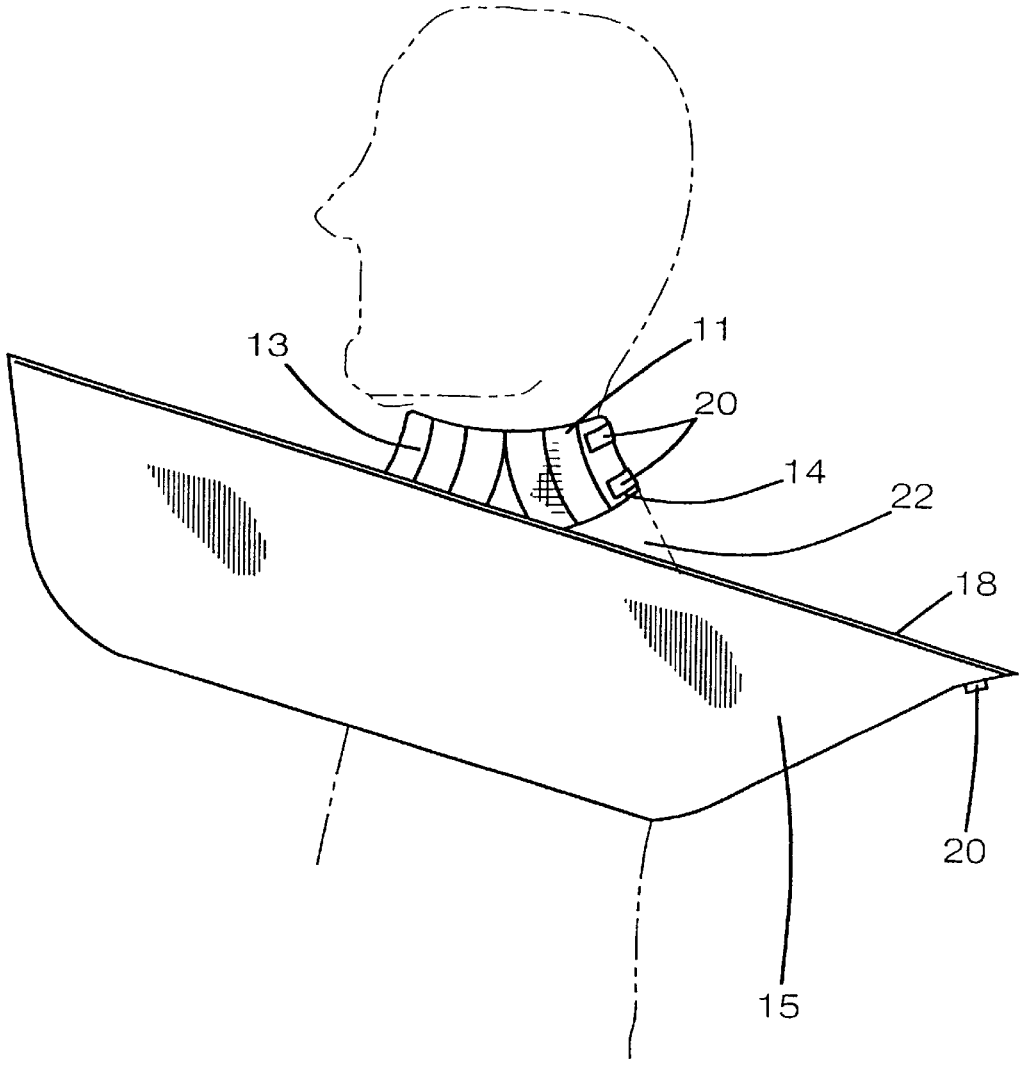
FIG. 4 is a side elevational view of the present invention shown in use.

With reference now to the drawings, and in particular to FIGS. 1 through 4 thereof, a new hair clippings catching device embodying the principles and concepts of the present invention and generally designated by the reference numeral 10 will be described.

As best illustrated in FIGS. 1 through 4, the hair clippings catching device 10 generally comprises a neck band member 11 having ends 12 which are adapted to be removably fastened together about a user's neck 21. The neck band member 11 has a top portion 13 and a bottom portion 14 with the bottom portion 14 being flared outwardly to allow the user to comfortably wear the neck band member 11 about one's neck 21.

A cape assembly includes a piece of material 15 having ends 16 which are fastenable together to form an opening 17 centrally disposed therethrough and being adapted to extend about the users neck 21. The piece of material 15 has a perimeter which terminates in a loop 18. The cape assembly further includes a tubular member 19 being conventionally disposed in the loop 18 of the piece of material 15 and being adapted to suspend a perimeter portion of the piece of material 15 above a user's shoulders 22 thus forming a trough for catching hair clippings. The piece of material 15 is made of plastic and the tubular member 19 is made of a rigid plastic. Fastening members 20 are conventionally attached to the neck band member 11 and the piece of material 15. The fastening members 20 include strips of hook and loop fasteners being attached to the ends 12 of the neck band member 11 and to the ends 16 of the piece of material 15.

In use, the user secures the neck band member 11 about one's neck 21, and then secures the piece of material 15 upon one's shoulders 22 with the perimeter of the piece of material 15 being disposed upon the user's shoulders 22 thus forming a through to catch one's hair clippings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair clippings catching device comprising:

a neck band member having ends which are adapted to be removably fastened together to secure said band member about a user's neck;

a cape assembly comprising:

a support member for positioning about the neck and upper torso of the user, the support member having a perimeter wall extending about a central opening, said perimeter wall having an upper perimeter and a lower perimeter, said central opening having a relatively smaller transverse area at an intermediate location intermediate between said upper and lower perimeters and a relatively larger transverse area at said upper perimeter, an inner surface of said support member sloping upwardly from said intermediate location to said upper perimeter;

a piece of material having ends which are fastenable together to form an opening substantially centrally disposed therethrough and being adapted to extend about the user's neck, said piece of material being supportable by said support member for forming a trough for catching hair clippings falling from the user's head; and fastening members being attached to said neck band member and said piece of material.

2. A hair clippings catching device as described in claim 1, wherein said neck band member has a top portion and a bottom portion with said bottom portion being flared outwardly to allow the user to comfortably wear said neck band member about one's neck.

3. A hair clippings catching device as described in claim 1, wherein said piece of material has a perimeter which terminates in a loop.

4. A hair clippings catching device as described in claim 3, wherein said support member of said cape assembly is disposed in said loop of said piece of material.

5. A hair clippings catching device as described in claim 4, wherein said piece of material is made of plastic and said support member is made of a rigid plastic.

6. A hair clippings catching device as described in claim 1, wherein said fastening members includes strips of hook and loop fasteners being attached to said ends of said neck band member and to said ends of said piece of material.

7. A hair clippings catching device as described in claim 1, wherein said upper perimeter has a shape with a first pair of lobes protruding in opposite directions for positioning above shoulders of the user and a second pair of lobes protruding in opposite directions for positioning adjacent to front and back areas of the user's head, an axis connecting said first pair of lobes being oriented substantially perpendicular to an axis connecting said second pair of lobes, a distance between said first pair of lobes being greater than a distance between said second pair of lobes such that said support member extends laterally wider over the shoulders of the user when worn by the user.

8. A hair clippings catching device comprising:

a neck band member having ends which are adapted to be removably fastened together to secure said band member about a user's neck;

a cape assembly comprising:

a support member for positioning about the neck and upper torso of the user, the support member having a perimeter wall extending about a central opening, said perimeter wall having an upper perimeter and a lower perimeter, said central opening having a relatively smaller transverse area at an intermediate location intermediate between said upper and lower perimeters and a relatively larger transverse area at said upper perimeter, an inner surface of said support member sloping upwardly from said intermediate location to said upper perimeter;

a piece of material having ends which are fastenable together to form an opening substantially centrally disposed therethrough and being adapted to extend about the user's neck, said piece of material being supportable by said support member for forming a trough for catching hair clippings falling from the user's head; and fastening members being attached to said neck band member and said piece of material;

wherein said neck band member has a top portion and a bottom portion with said bottom portion being flared outwardly to allow the user to comfortably wear said neck band member about one's neck;

wherein said piece of material has a perimeter which terminates in a loop;

wherein said support member of said cape assembly is disposed in said loop of said piece of material;

wherein said piece of material is made of plastic and said support member is made of a rigid plastic;

wherein said fastening members includes strips of hook and loop fasteners being attached to said ends of said neck band member and to said ends of said piece of material; and wherein said upper perimeter has a shape with a first pair of lobes protruding in opposite directions for positioning above shoulders of the user and a second pair of lobes protruding in opposite directions for positioning adjacent to front and back areas of the user's head, an axis connecting said first pair of lobes being oriented substantially perpendicular to an axis connecting said second pair of lobes, a distance between said first pair of lobes being greater than a distance between said second pair of lobes such that said support member extends laterally wider over the shoulders of the user when worn by the user.

* * * * *